US012402719B2

(12) United States Patent
Lin

(10) Patent No.: US 12,402,719 B2
(45) Date of Patent: Sep. 2, 2025

(54) ASSEMBLY TABLE

(71) Applicant: GAIN-PING CO., LTD., New Taipei (TW)

(72) Inventor: Chiu-Ting Lin, New Taipei (TW)

(73) Assignee: GAIN-PING CO., LTD., New Taipei (TW)

( * ) Notice: Subject to any disclaimer, the term of this patent is extended or adjusted under 35 U.S.C. 154(b) by 152 days.

(21) Appl. No.: 18/466,846

(22) Filed: Sep. 14, 2023

(65) Prior Publication Data

US 2024/0130518 A1 Apr. 25, 2024
US 2024/0225264 A9 Jul. 11, 2024

(30) Foreign Application Priority Data

Oct. 20, 2022 (TW) ..... 111139740
Mar. 14, 2023 (TW) ..... 112109404

(51) Int. Cl.
*A47B 13/00* (2006.01)

(52) U.S. Cl.
CPC ..... *A47B 13/003* (2013.01)

(58) Field of Classification Search
CPC ..... A47B 13/003; A47B 13/02; A47B 3/06; A47B 2013/022
See application file for complete search history.

(56) References Cited

U.S. PATENT DOCUMENTS 1,747,691 A * 2/1930 Bellows ..... A47B 3/06 108/156
11,118,617 B1 * 9/2021 Isensee ..... F16B 12/50
11,369,192 B2 * 6/2022 Grabowski ..... A47B 13/021
2003/0215375 A1 * 11/2003 Peddicord ..... A47B 13/02 422/275
2013/0220188 A1 * 8/2013 Wei Siao ..... A47B 13/02 108/158.11

(Continued)

FOREIGN PATENT DOCUMENTS

CN 104047940 A 9/2014
CN 209883371 U 1/2020

(Continued)

OTHER PUBLICATIONS

English translation of CN212260824 (Year: 2025).*

*Primary Examiner* — Daniel J Rohrhoff
(74) *Attorney, Agent, or Firm* — CKC & Partners Co., LLC

(57) ABSTRACT

An assembly table includes a table board, a fixing frame and a plurality of detachable table legs. The table board includes an upper surface and a lower surface, and the fixing frame is fixed on the lower surface of the table board. In addition, the fixing frame includes a plurality of connecting devices, connecting rods and connecting rod stability adjustment modules. The connection devices include a plurality of lock protrusions and a plurality of adjusting seats, and a plurality of openings are formed on the connecting rods for locking to the lock protrusions of the connection devices. The connecting rod stability adjustment modules are installed on the connecting devices, and each of the connecting rod stability adjusting modules includes an adjusting screw, pre-locked in a corresponding adjustment seat of the adjustment seats of the connecting devices to stably connect the connecting rods.

10 Claims, 7 Drawing Sheets

(56) References Cited

U.S. PATENT DOCUMENTS

| | | | | |
|---|---|---|---|---|
| 2015/0208798 | A1* | 7/2015 | Glenn, II | F16B 12/40 248/188.7 |
| 2017/0209784 | A1* | 7/2017 | Pavey | A47B 25/00 |
| 2017/0292549 | A1* | 10/2017 | Del Missier | F16B 1/00 |
| 2020/0170405 | A1* | 6/2020 | Grabowski | A47B 13/02 |

FOREIGN PATENT DOCUMENTS

| | | | | |
|---|---|---|---|---|
| CN | 111743296 | A | | 10/2020 |
| CN | 111820588 | A | | 10/2020 |
| CN | 212260824 | U | | 1/2021 |
| KR | 20170055775 | A | * | 10/2017 |
| TW | M444163 | U | | 1/2013 |
| TW | M523352 | U | | 6/2016 |
| TW | M566009 | U | | 9/2018 |
| TW | M594892 | U | | 5/2020 |
| TW | M599591 | U | | 8/2020 |
| TW | M642138 | U | | 6/2023 |

* cited by examiner

ASSEMBLY TABLE

RELATED APPLICATIONS

This application claims priorities to Taiwan Application Serial Number 111139740, filed Oct. 20, 2022 and Taiwan Application Serial Number 112109404, filed Mar. 14, 2023, the disclosures of which are incorporated herein by reference in their entireties.

TECHNICAL FIELD

The present disclosure relates to an assembly table. More particularly, the present disclosure relates to an assembly table with detachable table legs.

BACKGROUND

With the progress of the society, the designs of various types of furniture are also more diversified. However, due to the dense population of the city, people's living space is gradually narrow. How to make full use of the limited space through proper furniture configuration, release the existing space to store the furniture and use the furniture space in time when needed may provide users with effective space utilization.

Some assembly table can be conveniently stored, and the assembly table can be detached and stored when not in use to reduce the occupied space, and therefore the assembly table has become one of the commonly used equipment at home and in the workplace. In addition, the simple appearance of the assembly table can adapt to various home styles or be used as a work table, a conference table, or even a display table. Therefore, the assembly table can be widely used in home life and in the office.

Therefore, there is a need to provide a more stable and safe assembly table able to flexibly adapt to different size table boards and be conveniently assembled.

SUMMARY

The summary of the present invention is intended to provide a simplified description of the disclosure to enable readers to have a basic understanding of the disclosure. The summary of the present invention is not a complete overview of the disclosure, and it is not intended to point out the importance of the embodiments/key elements of the present invention or define the scope of the invention.

One objective of the embodiments of the present invention is to provide an assembly table able to be conveniently stored, transported, used and accommodated.

To achieve these and other advantages and in accordance with the objective of the embodiments of the present invention, as the embodiment broadly describes herein, the embodiments of the present invention provides an assembly table including a table board, a fixing frame and a plurality of detachable table legs. The table board includes an upper surface and a lower surface, and the fixing frame is fixed on the lower surface of the table board. In addition, the fixing frame includes a plurality of connecting devices, a plurality of connecting rods and a plurality of connecting rod stability adjustment modules. The connecting devices include a plurality of lock protrusions and a plurality of adjusting seats, the connecting rods are connected between the connecting devices, and the connecting rods include a plurality of openings to lock to the lock protrusions of the connecting devices. The connecting rod stability adjustment modules are installed on the connecting devices, and each of the connecting rod stability adjustment modules includes an adjusting screw pre-locked in a corresponding adjustment seat of the adjustment seats of the connecting devices. In addition, a protruding length of the adjusting screw protruding from the corresponding adjusting seat is adjusted to stably connect the connecting rods on the connecting devices after the connecting rods are connected to the connecting devices. In addition, the detachable table legs are detachably installed on the fixing frame.

In some embodiments, the fixing frame further includes a plurality of assembly connecting modules to fix to another assembly table.

In some embodiments, the assembly connecting modules include a plurality of fixing shafts and a plurality of rotary lock devices. The fixing shafts are fixed on the connecting devices and the rotary lock devices are pivoted on some of the connecting devices to lock fixing shafts of the another assembly table.

In some embodiments, each of the rotary lock devices includes a rotating ring, an extension rod, a fastening hook and an operating handle. The rotating ring is pivoted on one corresponding fixing shaft of the connecting devices, the extension rod is connected to the rotating ring, the fastening hook is connected to the extension rod to lock a fixing shaft on the another assembly table and the operating handle is connected to the fastening hook to rotate the fastening hook.

In some embodiments, the connecting devices are angle adjustable connecting devices fixed on the lower surface of the table board and angles the angle adjustable connecting devices are adjusted according to a shape of the table board and lengths of the connecting rods.

In some embodiments, the connecting rods include at least one first connecting rod and at least one second connecting rod. The lengths of the first connecting rod and the second connecting rod are different.

In some embodiments, each of the angle adjustable connecting device includes a first angle adjustment unit and a second angle adjustment unit. The first angle adjustment unit is connected to the first connecting rod and the second angle adjustment unit is connected to the second connecting rod and engaged with the first angle adjustment unit to determine and fix an angle between the first connecting rod and the second connecting rod.

In some embodiments, the first angle adjustment unit includes a first rotating part, a connecting rod fixing part and a first engaging gear. The connecting rod fixing part is connected to the first rotating part and locks the first connecting rod. The first engaging gear is formed on the first rotating part. In addition, the second angle adjustment unit includes a second rotating part, a connecting rod fixing part and a second engaging gear. The connecting rod fixing part is connected to the second rotating part and locks the second connecting rod and the second engaging gear is formed on the second rotating part to engage with the first engaging gear so as to fix the angle between the first connecting rod and the second connecting rod.

In some embodiments, each of the detachable table legs includes a table leg main body and a fixing device. The fixing device is connected to one end of the table leg main body to lock in a fixing hole of the first rotating part to clamp the second rotating part between the table leg main body and the first rotating part.

In some embodiments, the fixing device is a quick release fixing device to engage in a fixing slot of the first rotating part so as to clamp the second rotating part between the table leg main body and the first rotating part.

Hence, the assembly table according to some embodiments of the present invention can not only be stored and accommodated conveniently, but also can be installed and moved conveniently, and the angle adjustment unit is locked by the detachable table legs to tightly fix the angle adjustment unit on the fixing frame, and the strength and stability of the assembly table may be further increased by the connecting rod stability adjustment module. In addition, the fixing frame can be pre-fixed on the bottom surface of the table board, and the fixing frame does not need to be removed from the bottom surface of the table board when disassembling the table legs so that the assembly table may be more conveniently assembled and stored.

BRIEF DESCRIPTION OF THE DRAWINGS

The disclosure can be more fully understood by reading the following detailed description of the embodiment, with reference made to the accompanying drawings as follows.

DETAILED DESCRIPTION OF THE PREFERRED EMBODIMENT

Figure 1:
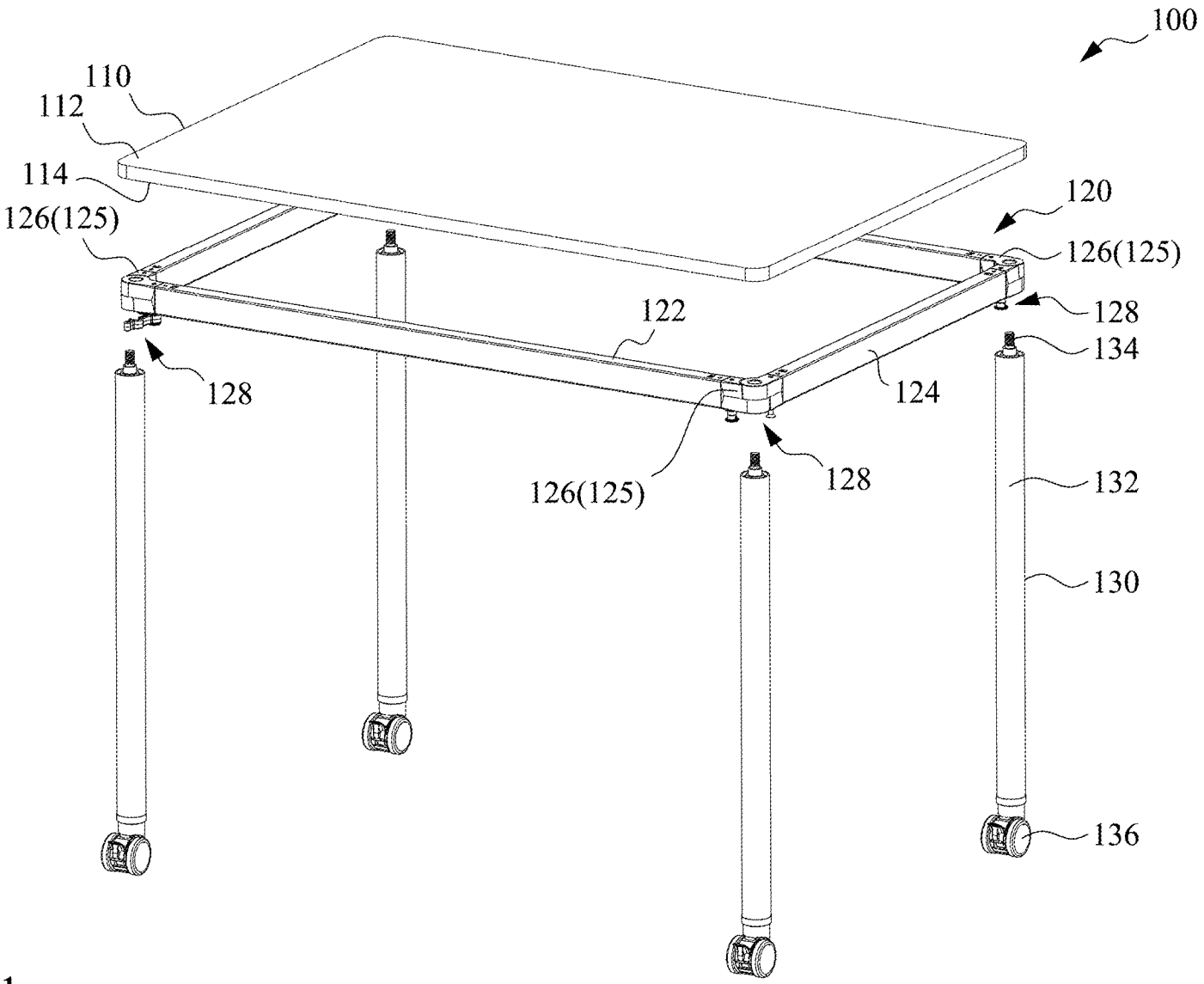
FIG. 1 illustrates an exploded diagram showing an assembly table according to one embodiment of the present invention.

The following is a detailed description of the embodiments in conjunction with the accompanying drawings, but the provided embodiments are not intended to limit the scope of the disclosure, and the description of the structure and operation is not used to limit the execution sequence thereof. The structure of the recombination of components and the resulting devices with equal functions are all within the scope of this disclosure. In addition, the drawings are for illustration purposes only, and are not drawn according to the original scale. For ease of understanding, the same reference numbers are used in the drawings and the description to refer to the same or like parts.

In addition, the terms used in the entire description and the scope of the patent application, unless otherwise specified, usually have the usual meaning of each term used in this field, in the content disclosed here and in the special content. Some terms used to describe the disclosure are discussed below or elsewhere in this specification to provide additional guidance to those skilled in the art in the disclosure.

In the implementation mode and the scope of the present application, unless the article is specifically limited in the context, "a" and "the" can generally refer to a single or pluralities. In the steps, the numbering is only used to conveniently describe the steps, rather than to limit the sequence and implementation.

Secondly, the words "comprising", "including", "having", "containing" and the like used in the present application are all open language, meaning including but not limited to.

Figure 2:
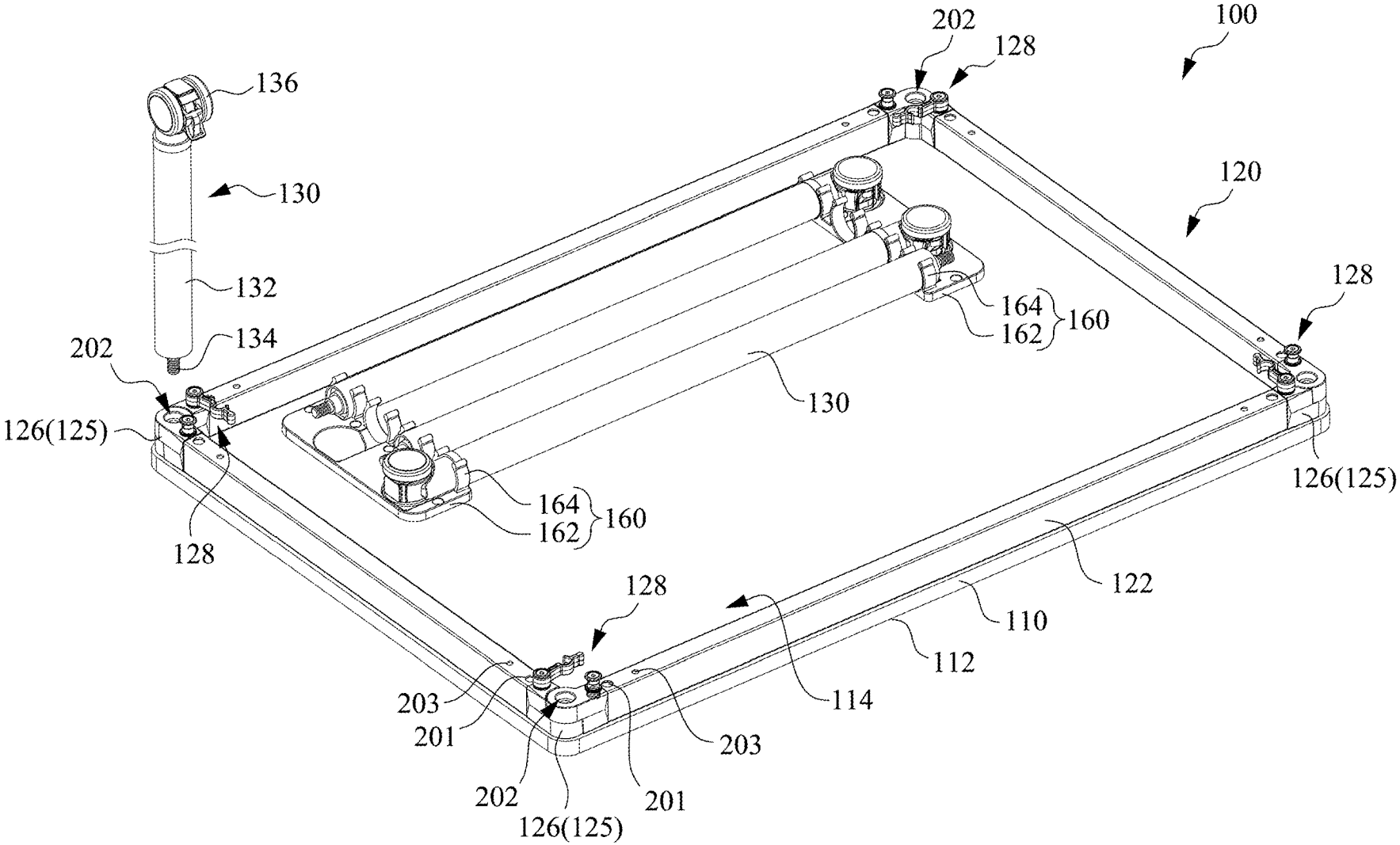
FIG. 2 illustrates a schematic perspective diagram showing a lower surface of the assembly table.
Figure 3:
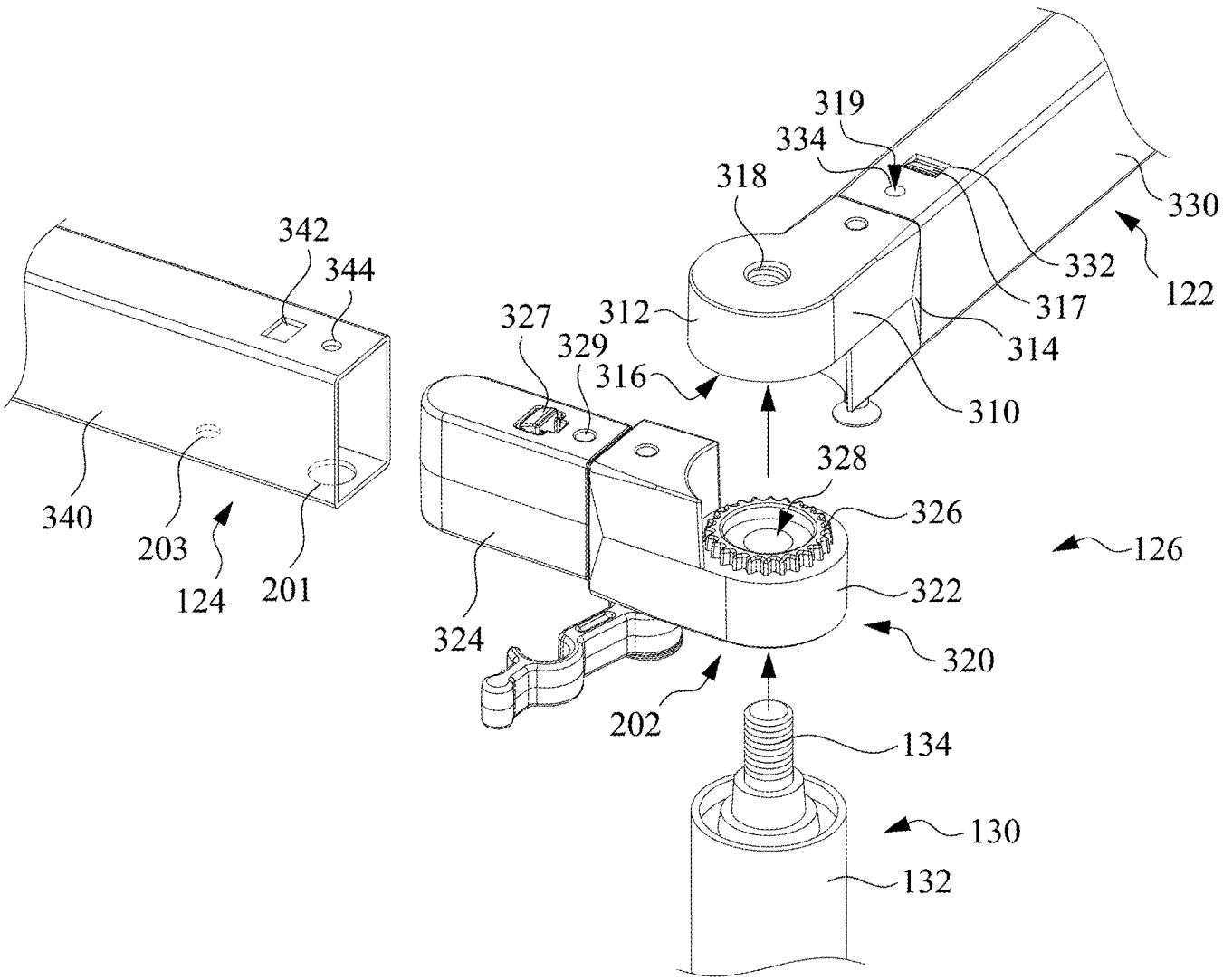
FIG. 3 illustrates an exploded diagram showing a connecting device of the assembly table.
Figure 4:
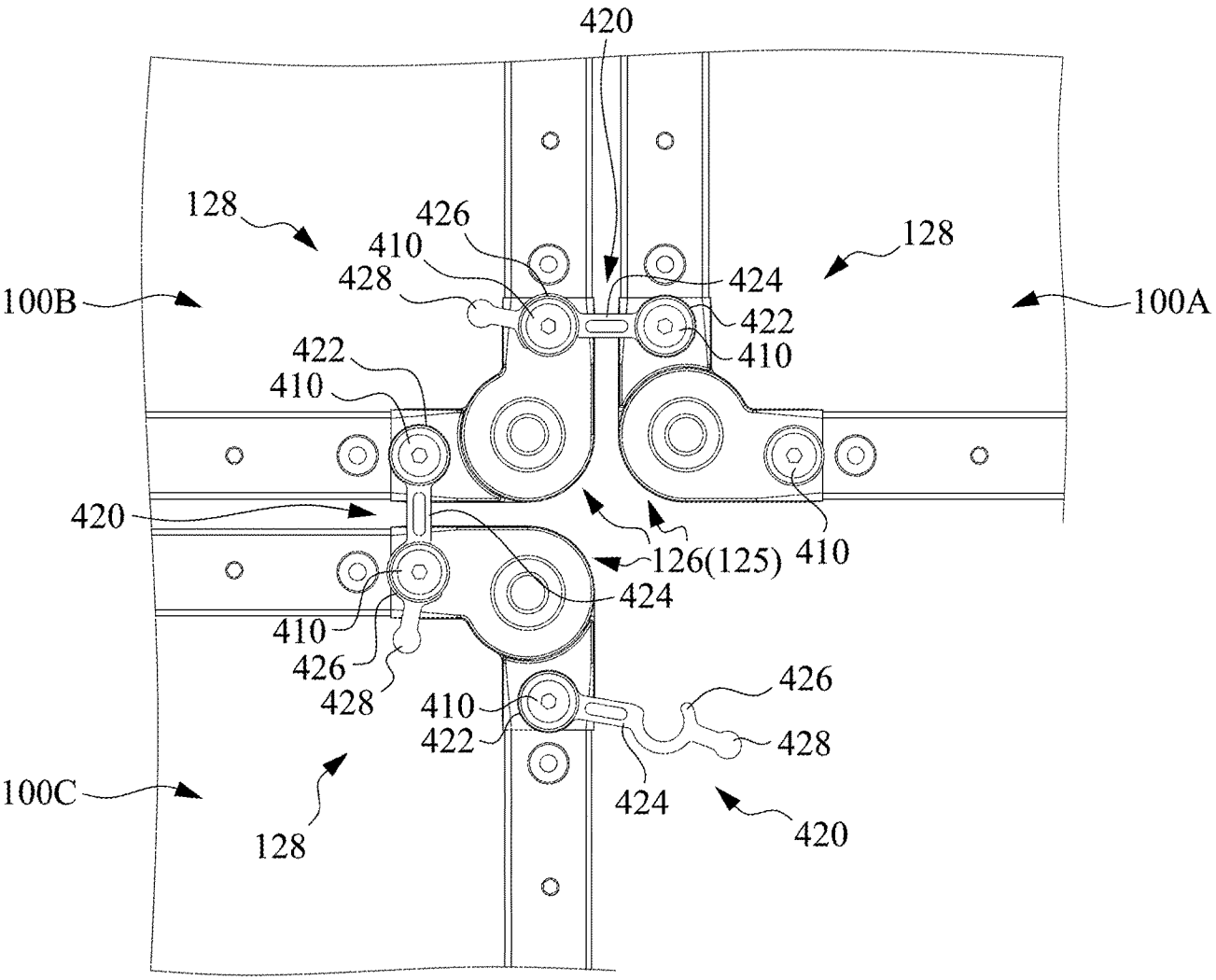
FIG. 4 illustrates a schematic diagram showing a plurality of assembly tables connected together.
Figure 5:
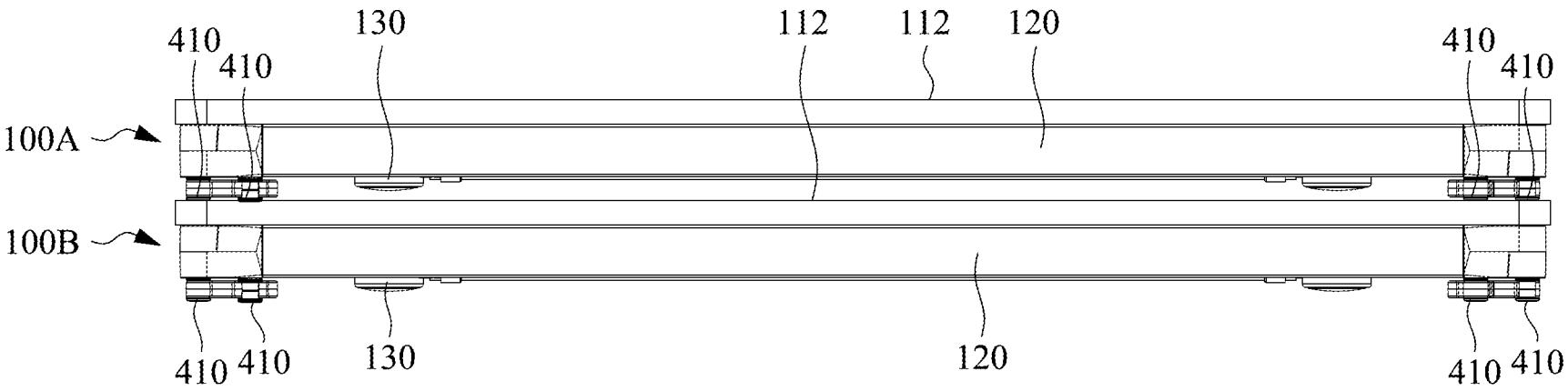
FIG. 5 illustrates a schematic diagram showing a plurality of assembly tables stacked together.
Figure 6:
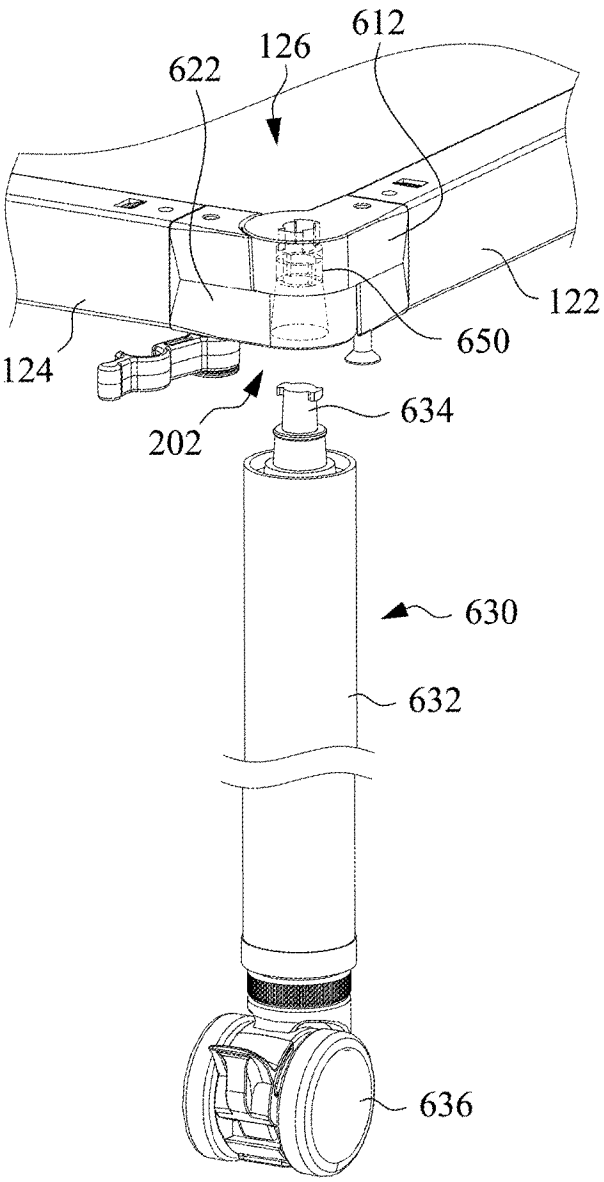
FIG. 6 illustrates a schematic diagram showing a quick release fixing device of the assembly table.
Figure 7:
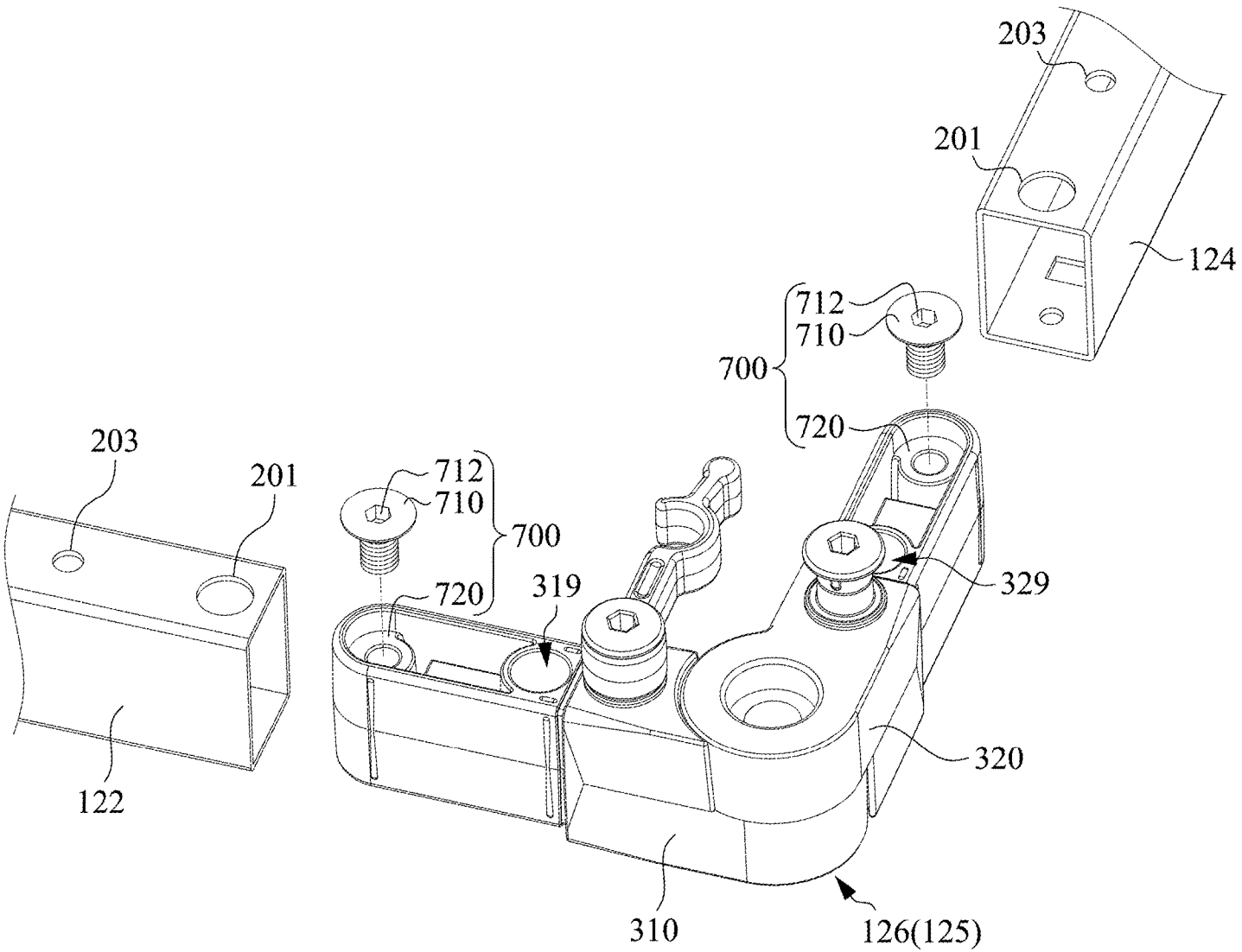
FIG. 7 illustrates a schematic diagram showing a connecting rod stability adjustment module of the assembly table.

FIG. 1 illustrates an exploded diagram of the assembly table according to one embodiment of the present invention, FIG. 2 illustrates a schematic perspective diagram of the lower surface of the assembly table, FIG. 3 illustrates an exploded diagram of the connecting device of the assembly table, FIG. 4 illustrates a schematic diagram of a plurality of assembly tables connected together, FIG. 5 illustrates a schematic diagram of a plurality of assembly tables stacked together, and FIG. 6 illustrates a schematic diagram of the quick release fixing device of the assembly table. In addition, FIG. 7 illustrates a schematic diagram of the connecting rod stability adjustment module of the assembly table.

First referring to FIG. 1 and FIG. 2, the assembly table 100 includes a table board 110, a fixing frame 120 and a plurality of detachable table legs 130. The table board 110 includes an upper surface 112 and a lower surface 114, and the fixing frame 120 is fixed on the lower surface 114 of the table board 110. In addition, the fixing frame 120 includes a plurality of connecting devices 125 and a plurality of connecting rods, for example, a first connecting rod 122 and a second connecting rod 124. The connecting rods are connected between the connecting devices 125.

In some embodiments, the connecting devices 125 is an angle adjustable connecting device 126 able to adjust the angle thereof according to the shape of the table board 110 and the lengths of the connecting rods so as to conveniently fix on the lower surface 114 of the table board 110.

In some embodiments, three connecting rods and three angle adjustable connecting devices 126 may be form a triangle fixing frame. In some embodiments, four connecting rods and four angle adjustable connecting devices 126 may be formed a rectangular fixing frame or any kind of quadrilateral fixing frame without departing from the spirit and scope of the disclosure. The fixing frame 120 may be formed into any shape according to the actual shape of the table board 110 with required connecting rods and angle adjustable connecting device 126 to support the table board 110, and users may adjust the shape of the fixing frame 120 according to the actual demand without departing from the spirit and scope of the disclosure.

In some embodiments, the lengths of the first connecting rod 122 and the second connecting rod 124 are different.

In addition, a plurality of detachable table legs 130 are detachably installed on the fixing frame 120, and fixed on the angle adjustable connecting device 126 of the fixing frame 120 to effectively support the table board 110 and the fixing frame 120.

In some embodiments, the connecting device 125 may be a fixed connecting device connected between the first connecting rod 122 and the second connecting rod 124 without departing from the spirit and scope of the disclosure.

In some embodiments, the fixing frame 120 further includes a plurality of assembly connecting modules 128 to fix to other assembly tables 100.

Simultaneously referring to FIG. 4, as shown in the figures, the assembly connecting module 128 includes a plurality of fixing shafts 410 and a plurality of rotary lock devices 420. The fixing shafts 410 are fixed on the connecting devices 125, i.e. the angle adjustable connecting devices 126, and the rotary lock device 420 are pivoted on some angle adjustable connecting devices 126 to lock to corresponding fixing shafts 410 on another assembly table 100. Three assembly tables 100A, 100B and 100C are illustrated as an example, corners of the first assembly table 100A, the second assembly table 100B, and the third assembly table 1000 are shown to further explain the assembly connecting module 128.

In some embodiments, each of the rotary lock devices 420 includes a rotating ring 422, an extension rod 424, a fastening hook 426 and an operating handle 428. The rotating ring 422 is pivoted on the fixing shaft 410 so as to able to rotate on the fixing shaft 410. The extension rod 424 is connected to the rotating ring 422, the fastening hook 426 is connected to the extension rod 424 to lock to the fixing shaft 410 of the other assembly table 100. Taking the rotary lock device 420 of the first assembly table 100A as an example, the rotary lock device 420 of the first assembly table 100A may rotate about 180 degrees to lock to the fixing shaft 410 of the second assembly table 100B. The rotary lock device 420 of the second assembly table 100B may also rotate about 180 degrees to lock to the fixing shaft 410 of the third assembly table 1000. In addition, the rotary lock device 420 of the third assembly table 1000 is be rotated about 165 degrees to expose the rotary lock device 420 outside the lower surface of the third assembly table 100C to show the appearance shape of the rotary lock device 420.

In some embodiments, the rotary lock device 420 is preferably stored under the lower surface 114 of the table board 110 rather than being exposed outside the lower surface 114 of the table board 110 of the third assembly table 1000 as illustrated on FIG. 4 in order to prevent users from inadvertently touching the rotary lock device 420 or the rotary lock device 420 hitting the surface of the other object to cause injury to the user or the equipment. In some embodiments, the rotary lock device 420 preferably includes a fixing element to fix and hide the rotary lock device 420 under the lower surface 114 of the table board 110. When using the assembly table 100, the user may rotate the rotary lock device 420 to the outside the lower surface 114 of the table board 110 to conveniently lock the rotary lock device 420 to the fixing shaft 410 of another assembly table 100.

In addition, the operating handle 428 is connected to the fastening hook 426 so that the user may conveniently rotate the rotary lock device 420 to lock the fastening hook 426 to the fixing shaft 410 of another assembly table 100.

Referring to FIG. 3, as shown in the figure, in some embodiments, the angle adjustable connecting device 126 includes a first angle adjustment unit 310 and a second angle adjustment unit 320. The first angle adjustment unit 310 is detachably connected to the first connecting rod 122, the second angle adjustment unit 320 is detachably connected to the second connecting rod 124, and the first angle adjustment unit 310 and the second angle adjustment unit 320 may adjust and fix the angle between the first connecting rod 122 and the second connecting rod 124.

In some embodiments, the first angle adjustment unit 310 includes a first rotating part 312, a connecting rod fixing part 314 and a first engaging gear 316. The second angle adjustment unit 320 includes a second rotating part 322, a connecting rod fixing part 324 and a second engaging gear 326.

The connecting rod fixing part 314 is connected to the first connecting rod 122. In some embodiments, the connecting rod fixing part 314 is locked to the first connecting rod 122. Another end of the connecting rod fixing part 314 is connected to the first rotating part 312, and the first engaging gear 316 is formed on the first rotating part 312.

In addition, the connecting rod fixing part 324 of the second angle adjustment unit 320 is connected to the second connecting rod 124. In some embodiments, the connecting rod fixing part 324 of the second angle adjustment unit 320 is locked to the second connecting rod 124. Another end of the connecting rod fixing part 324 is connected to the second rotating part 322, and the second engaging gear 326 is formed on the second rotating part 322 and engaged with the first engaging gear 316 to effectively fix the angle between the first connecting rod 122 and the second connecting rod 124.

In some embodiments, the first engaging gear 316 is an internal gear, and the second engaging gear 326 is an external gear, but not limited thereto. In some embodiments, the first engaging gear 316 may be a groove and the second engaging gear 326 may be a protrusion, or the first engaging gear 316 may be a protrusion and the second engaging gear 326 may be a groove without departing from the spirit and scope of the present invention.

In some embodiments, the detachable table leg 130 includes a table leg main body 132 and a fixing device 134. The fixing device 134 is connected to one end of the table leg main body 132, penetrated into the table leg fixing hole 202, and fixed in the fixing hole 318 of the first rotating part 312 so that the second rotating part 322 is clamped between the table leg main body 132 and the first rotating part 312.

In some embodiments, the fixing hole 318 has a female thread, and the fixing device 134 of the detachable table legs 130 has a male thread to lock each other so that the first engaging gear 316 of the first rotating part 312 and the second engaging gear 326 of the second rotating part 322 are firmly engaged together, thereby enhancing the rigidity of the fixing frame 120 and improving the strength and stability of the assembly table 100.

In some embodiments, simultaneously referring to FIG. 1 to FIG. 3, the second connecting rod 124 is formed by a rectangular tube 340, and a table board fixing hole 201, a fixing hole 344 and an openings 342 are formed thereon. In addition, the connecting rod fixing part 324 of the second angle adjustment unit 320 includes a lock protrusion 327 and a fixing hole 329, the lock protrusion 327 may lock to the opening 342 of the rectangular tube 340 to fix the second connecting rod 124 on the connecting rod fixing part 324 of the second angle adjustment unit 320. At this moment, the fixing hole 329 of the connecting rod fixing part 324 is aligned with the fixing hole 344 and the table board fixing hole 201 of the rectangular tube 340.

Because the lock protrusion 327 of the connecting rod fixing part 324 is locked to the opening 342 of the rectangular tube 340, the second connecting rod 124 may be conveniently installed on the second angle adjustment unit 320 or removed from the second angle adjustment unit 320 so as to further improve the convenience of assembling the assembly table 100.

In addition, the table board fixing hole 201 is preferably larger than the fixing hole 344, and the fixing hole 329 is a countersunk hole, the lower hole diameter is larger than the upper hole diameter, so that a fixing device, such as a screw, may pass through the table board fixing hole 201 and be fixed in the fixing hole 329 of the connecting rod fixing part 324, and therefore the second connecting rod 124 and the second angle adjustment unit 320 are effectively fixed on the lower surface 114 of the table board 110.

In the same manner, the first connecting rod 122 is formed by a rectangular tube 330, and a table board fixing hole 201, a fixing hole 334 and an openings 332 are formed thereon. In addition, the connecting rod fixing part 314 of the first angle adjustment unit 310 includes a lock protrusion 317 and a fixing hole 319, the lock protrusion 317 may lock to the opening 332 of the rectangular tube 330 to fix the first connecting rod 122 on the connecting rod fixing part 314 of the first angle adjustment unit 310. At this moment, the fixing hole 319 of the connecting rod fixing part 314 is aligned with the fixing hole 334 and the table board fixing hole 201 of the rectangular tube 330.

Because the lock protrusion 317 of the connecting rod fixing part 314 is locked to the opening 332 of the rectangular tube 330, the first connecting rod 122 may be conveniently installed on the first angle adjustment unit 310 or removed from the first angle adjustment unit 310 so as to further improve the convenience of assembling the assembly table 100.

In addition, the table board fixing hole 201 is preferably larger than the fixing hole 334, and the fixing hole 319 is a countersunk hole, the lower hole diameter is larger than the upper hole diameter, so that a fixing device, such as a screw, may pass through the table board fixing hole 201 and be fixed in the fixing hole 319 of the connecting rod fixing part 314, and therefore the first connecting rod 122 and the first angle adjustment unit 310 are effectively fixed on the lower surface 114 of the table board 110.

In addition, after the first connecting rod 122 is engaged with the first angle adjustment unit 310 and the second connecting rod 124 is engaged with the second angle adjustment unit 320, a user may conveniently engage the first engaging gear 316 of the first rotating part 312 of the first angle adjustment unit 310 with the second engaging gear 326 of the second rotating part 322 of the second angle adjustment unit 320 according to a required angle, and fix the first connecting rod 122, the first angle adjustment unit 310, the second connecting rod 124 and the second angle adjustment unit 320 on the lower surface 114 of the table board 110 with the fixing devices such as the screws.

The user may screw the fixing device 134 of the detachable table legs 130 into the fixing hole 318 of the first rotating part 312 along the table leg fixing hole 202 through the through hole 328 of the second rotating part 322 so that the second rotating part 322 are clamped between the table leg main body 132 and the first rotating part 312 to enhance the strength and stability of the assembly table 100.

In some embodiments, the detachable table leg 130 further includes a sliding wheel 136 installed on another end of the table leg main body 132 to conveniently move the assembly table 100. However, the present invention is not limited thereto, the another end of the table leg main body 132 may also be equipped with a height adjuster or an anti-slip pad, without departing from the spirit and scope of the present invention.

In some embodiments, the assembly table 100 further includes a table leg storage device 160 fixed on the lower surface 114 of the table board 110 to accommodate the detachable table legs 130 while the assembly table 100 is stored. The table leg storage device 160 includes a fixing base 162 and a plurality of hook claws 164. The fixing base 162 is fixed on the lower surface 114 of the table board 110, and the hook claws 164 are formed on the fixing base 162 to accommodate and fix the detachable table legs 130. In some embodiments, two table leg storage devices 160 are preferably fixed on two ends of the lower surface 114 of the table board 110 to stably fix the detachable table legs 130.

Referring to FIG. 5, a first assembly table 100A and a second assembly table 100B are stored and stacked together as an example. In some embodiments, the fixing shafts 410 of the first assembly table 100A may be stacked on the upper surface 112 of the table board 110 of the second assembly table 1001B, and the fixing shafts 410 of the second assembly table 1001B may be placed on the ground or on an upper surface of another assembly table to effectively protect the surface of the table board 110 from being scratched and facilitate storage or movement. The fixing shaft 410 is protruded on the fixing frame 120 and the detachable table legs 130 are stored in the fixing frame 120 so that the detachable table legs 130 is less than the height of the fixing shaft 410 measured from the fixing frame 120 so that the detachable table legs 130 can be effectively protected by the fixing frame 120 to prevent from the detachable table legs 130 from being damaged during storage or moving, thereby increasing the service life of the assembly table 100.

In some embodiments, referring to FIG. 6, the detachable table leg 630 includes a table leg main body 632, a quick release fixing device 634 and a sliding wheel 636. The quick release fixing device 634 may quickly be fixed in the fixing slot 650 of the first rotating part 612 so that the second rotating part 622 is clamped between the table leg main body 632 and the first rotating part 612 to increase the strength and stability of the fixing frame and conveniently install and remove the detachable table legs 630.

In some embodiments, referring to FIG. 7, the connecting device 125 further includes a connecting rod stability adjustment module 700 to stably fix the first connecting rod 122 and the second connecting rod 124 to the connecting device 125. In addition, the connecting device 125 can be an fixed angle connecting device or an angle adjustable connecting device 126.

The angle adjustable connecting device 126 is illustrated as an example. The first angle adjustment unit 310 and the second angle adjustment unit 320 respectively include a connecting rod stability adjustment module 700 to stably fix the first connecting rod 122 and the second connecting rod 124 on the first angle adjustment unit 310 and the second angle adjustment unit 320. As shown in the figure, the connecting rod stability adjustment module 700 includes an adjusting screw 710 pre-locked in a corresponding adjustment seat 720. The table board fixing holes 201 of the first connecting rod 122 and the second connecting rod 124 are respectively aligned with the fixing hole 319 of the first angle adjustment unit 310 and the fixing hole 329 of the second angle adjustment unit 320, and then the first angle adjustment unit 310 and the second angle adjustment unit 320 are fixed on the lower surface 114 of the table board 110 with the fixing devices such as screws. At this moment, the connecting rod adjusting hole 203 is aligned with the countersunk hole 712, i.e. a hexagonal countersunk hole, to allow the user using a tool such as a hexagonal wrench to adjust the height of the adjusting screw 710 protruding from the adjusting seat 720 through the connecting rod adjusting hole 203. The upper surface of the adjusting screw 710 may abut against the inner surfaces of the first connecting rod 122 and the second connecting rod 124 to tightly fit the first connecting rod 122 and the second connecting rod 124 on the first angle adjustment unit 310 and the second angle adjustment unit 320 by the pressure exerted by the adjusting screw 710 so as to prevent from sliding or rotation of the first connecting rod 122 and the second connecting rod 124 on the first angle adjustment unit 310 and the second angle adjustment unit 320, thereby improving the stability of the first connecting rod 122, the second connecting rod 124, the first angle adjustment unit 310 and the second angle adjustment unit 320 and further improving the stability of the assembly table 100. Therefore, the connecting rod stability adjustment module 700 may stably fix the first connecting rod 122 and the second connecting rod 124 on the connecting device 125. After the openings of the first connecting rod 122 and the second connecting rod 124 are respectively locked with the lock protrusions of the connecting devices 125, the connecting rod stability adjustment module 700 may further stably fix the first connecting rod 122 and the second connecting rod 124 on the connecting devices 125 to effectively improve the stability of the first connecting rod 122 and the second connecting rod 124 on the connecting devices 125 so as to further improve the stability of the assembly table 100.

Accordingly, the assembly table according to some embodiments of the present invention can not only be stored and accommodated conveniently, but also can be installed and moved conveniently, and the angle adjustment unit is locked by the detachable table legs to tightly fix the angle adjustment unit on the fixing frame, and the strength and stability of the assembly table may be further increased by the connecting rod stability adjustment module. In addition, the fixing frame can be pre-fixed on the bottom surface of the table board, and the fixing frame does not need to be removed from the bottom surface of the table board when disassembling the table legs so that the assembly table may be more conveniently assembled and stored.

Although the present disclosure has been disclosed above in terms of implementation, it is not intended to limit the present disclosure. Any person with ordinary knowledge in the field may make various variations and modifications without departing from the spirit and scope of the disclosure. Therefore, the spirit and scope of the appended claims should not be limited to the description of the embodiments contained herein.

What is claimed is:

1. An assembly table, comprising:

a table board, comprising an upper surface and a lower surface;

a fixing frame fixed on the lower surface of the table board, wherein the fixing frame comprises:

a plurality of connecting devices, wherein the connecting devices comprise a plurality of lock protrusions and a plurality of adjusting seats;

a plurality of connecting rods connected between the connecting devices, wherein the connecting rods comprise a plurality of connecting rod adjusting holes and a plurality of openings to lock to the lock protrusions of the connecting devices; and a plurality of connecting rod stability adjustment modules installed on the connecting devices, wherein each of the connecting rod stability adjustment modules comprises an adjusting screw pre-locked in a corresponding adjustment seat of the adjustment seats of the connecting devices, wherein a diameter of the adjusting screw is greater than a diameter of a corresponding connecting rod adjusting hole of the connecting rod adjusting holes, wherein a protruding length of the adjusting screw protruding from the corresponding adjusting seat is adjusted to allow the adjusting screw to press on an inner surface of an corresponding connecting rod of the connecting rods so as to stably connect the connecting rods on the connecting devices after the connecting rods are connected to the connecting devices, and the adjusting screw is hidden in the corresponding connecting rod adjusting hole; and a plurality of detachable table legs detachably installed on the fixing frame.

2. The assembly table of claim 1, wherein the fixing frame further comprises a plurality of assembly connecting modules to fix to another assembly table.

3. The assembly table of claim 2, wherein the assembly connecting modules comprise:

a plurality of fixing shafts fixed on the connecting devices; and a plurality of rotary lock devices pivoted on some of the connecting devices to lock fixing shafts of the another assembly table.

4. The assembly table of claim 3, wherein each of the rotary lock devices comprises:

a rotating ring pivoted on one corresponding fixing shaft of the connecting devices;

an extension rod connected to the rotating ring;

a fastening hook connected to the extension rod to lock a fixing shaft on the another assembly table; and an operating handle connected to the fastening hook to rotate the fastening hook.

5. The assembly table of claim 1, wherein the connecting devices are angle adjustable connecting devices fixed on the lower surface of the table board and angles the angle adjustable connecting devices are adjusted according to a shape of the table board and lengths of the connecting rods.

6. The assembly table of claim 5, wherein the connecting rods comprise:

at least one first connecting rod; and at least one second connecting rod, and lengths of the first connecting rod and the second connecting rod are different.

7. The assembly table of claim 6, wherein each of the angle adjustable connecting device comprises:

a first angle adjustment unit connected to the first connecting rod; and a second angle adjustment unit connected to the second connecting rod and engaged with the first angle adjustment unit to determine and fix an angle between the first connecting rod and the second connecting rod.

8. The assembly table of claim 7, wherein the first angle adjustment unit comprises:

a first rotating part;

a connecting rod fixing part connected to the first rotating part and locking the first connecting rod; and a first engaging gear formed on the first rotating part;

wherein the second angle adjustment unit comprises:

a second rotating part;

a connecting rod fixing part connected to the second rotating part and locking the second connecting rod; and a second engaging gear formed on the second rotating part to engage with the first engaging gear so as to fix the angle between the first connecting rod and the second connecting rod.

9. The assembly table of claim 8, wherein each of the detachable table legs comprises:

a table leg main body; and a fixing device connected to one end of the table leg main body to lock in a fixing hole of the first rotating part to clamp the second rotating part between the table leg main body and the first rotating part.

10. The assembly table of claim 9, wherein the fixing device is a quick release fixing device to engage in a fixing slot of the first rotating part so as to clamp the second rotating part between the table leg main body and the first rotating part.

* * * * *